US011129425B1

(12) United States Patent
Sulaiman

(10) Patent No.: US 11,129,425 B1
(45) Date of Patent: Sep. 28, 2021

(54) NOSE AND FACE WIPING GLOVE

(71) Applicant: Hussain Sulaiman, Brooklyn, NY (US)

(72) Inventor: Hussain Sulaiman, Brooklyn, NY (US)

( * ) Notice: Subject to any disclaimer, the term of this patent is extended or adjusted under 35 U.S.C. 154(b) by 119 days.

(21) Appl. No.: 16/558,392

(22) Filed: Sep. 3, 2019

(51) Int. Cl.
*A41D 19/00* (2006.01)

(52) U.S. Cl.
CPC ..... *A41D 19/0006* (2013.01); *A41D 2500/50* (2013.01)

(58) Field of Classification Search
CPC .. A41D 19/0006; A41D 2500/50; A47L 13/18
See application file for complete search history.

(56) References Cited

U.S. PATENT DOCUMENTS 4,096,309 A * 6/1978 Stillman ..... B32B 15/08 442/382
4,161,176 A * 7/1979 Harris, II ..... A61F 13/0226 602/58
4,244,057 A 1/1981 Burnham
D385,660 S 10/1997 Conterelli
6,360,373 B1 3/2002 Rehn
6,811,338 B1 * 11/2004 Manske, Jr. ..... A45D 40/00 401/7
6,973,675 B2 * 12/2005 Cheng ..... A41D 19/0058 2/161.7
D571,051 S 6/2008 Matthews
7,895,768 B2 3/2011 Vossoughi
7,914,866 B2 * 3/2011 Shannon ..... D21H 17/63 428/35.2
8,745,764 B2 6/2014 Niemeyer
9,241,518 B2 * 1/2016 Patkov ..... A41D 19/01505
2002/0103466 A1 8/2002 Petix
2004/0031120 A1 2/2004 Cherian
2006/0195966 A1 9/2006 Martin
2008/0016601 A1 * 1/2008 McCrorey ..... A41D 19/0006 2/159
2013/0219645 A1 8/2013 Dowd
2016/0316986 A1 * 11/2016 Oster ..... A47L 13/18

FOREIGN PATENT DOCUMENTS

DE 29522212 7/2000

* cited by examiner

*Primary Examiner* — Tajash D Patel
(74) *Attorney, Agent, or Firm* — Kyle A. Fletcher, Esq.

(57) ABSTRACT

The nose and face wiping glove is a garment. The nose and face wiping glove is adapted for use with a patient. The nose and face wiping glove is worn on the hand of a patient. The nose and face wiping glove is an absorbent structure. The absorbent structure of the nose and face wiping glove is intended to accumulate a fluid discharge from the nose of the patient. The nose and face wiping glove is a layered structure. The layered structure provides the patient with sequential access to a plurality of independent absorbent structures. The nose and face wiping glove is formed as a glove. The glove of the nose and face wiping glove is formed from a composite textile.

18 Claims, 5 Drawing Sheets

NOSE AND FACE WIPING GLOVE

CROSS REFERENCES TO RELATED APPLICATIONS

Not Applicable

STATEMENT REGARDING FEDERALLY SPONSORED RESEARCH

Not Applicable

REFERENCE TO APPENDIX

Not Applicable

BACKGROUND OF THE INVENTION

Field of the Invention

The present invention relates to the field of wearing apparel including outerwear, more specifically, a protective glove with an accessory. (A41D19/01594)

SUMMARY OF INVENTION

The nose and face wiping glove is a garment. The nose and face wiping glove is adapted for use with a patient. The nose and face wiping glove is worn on the hand of a patient. The nose and face wiping glove is an absorbent structure. The absorbent structure of the nose and face wiping glove is intended to accumulate a fluid discharge from the nose of the patient. The nose and face wiping glove is a layered structure. The layered structure provides the patient with sequential access to a plurality of independent absorbent structures. The nose and face wiping glove is formed as a glove. The glove of the nose and face wiping glove is formed from a composite textile.

These together with additional objects, features and advantages of the nose and face wiping glove will be readily apparent to those of ordinary skill in the art upon reading the following detailed description of the presently preferred, but nonetheless illustrative, embodiments when taken in conjunction with the accompanying drawings.

In this respect, before explaining the current embodiments of the nose and face wiping glove in detail, it is to be understood that the nose and face wiping glove is not limited in its applications to the details of construction and arrangements of the components set forth in the following description or illustration. Those skilled in the art will appreciate that the concept of this disclosure may be readily utilized as a basis for the design of other structures, methods, and systems for carrying out the several purposes of the nose and face wiping glove.

It is therefore important that the claims be regarded as including such equivalent construction insofar as they do not depart from the spirit and scope of the nose and face wiping glove. It is also to be understood that the phraseology and terminology employed herein are for purposes of description and should not be regarded as limiting.

BRIEF DESCRIPTION OF DRAWINGS

The accompanying drawings, which are included to provide a further understanding of the invention are incorporated in and constitute a part of this specification, illustrate an embodiment of the invention and together with the description serve to explain the principles of the invention. They are meant to be exemplary illustrations provided to enable persons skilled in the art to practice the disclosure and are not intended to limit the scope of the appended claims.

DETAILED DESCRIPTION OF THE EMBODIMENT

The following detailed description is merely exemplary in nature and is not intended to limit the described embodiments of the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to practice the disclosure and are not intended to limit the scope of the appended claims. Furthermore, there is no intention to be bound by any expressed or implied theory presented in the preceding technical field, background, brief summary or the following detailed description.

Figure 1:
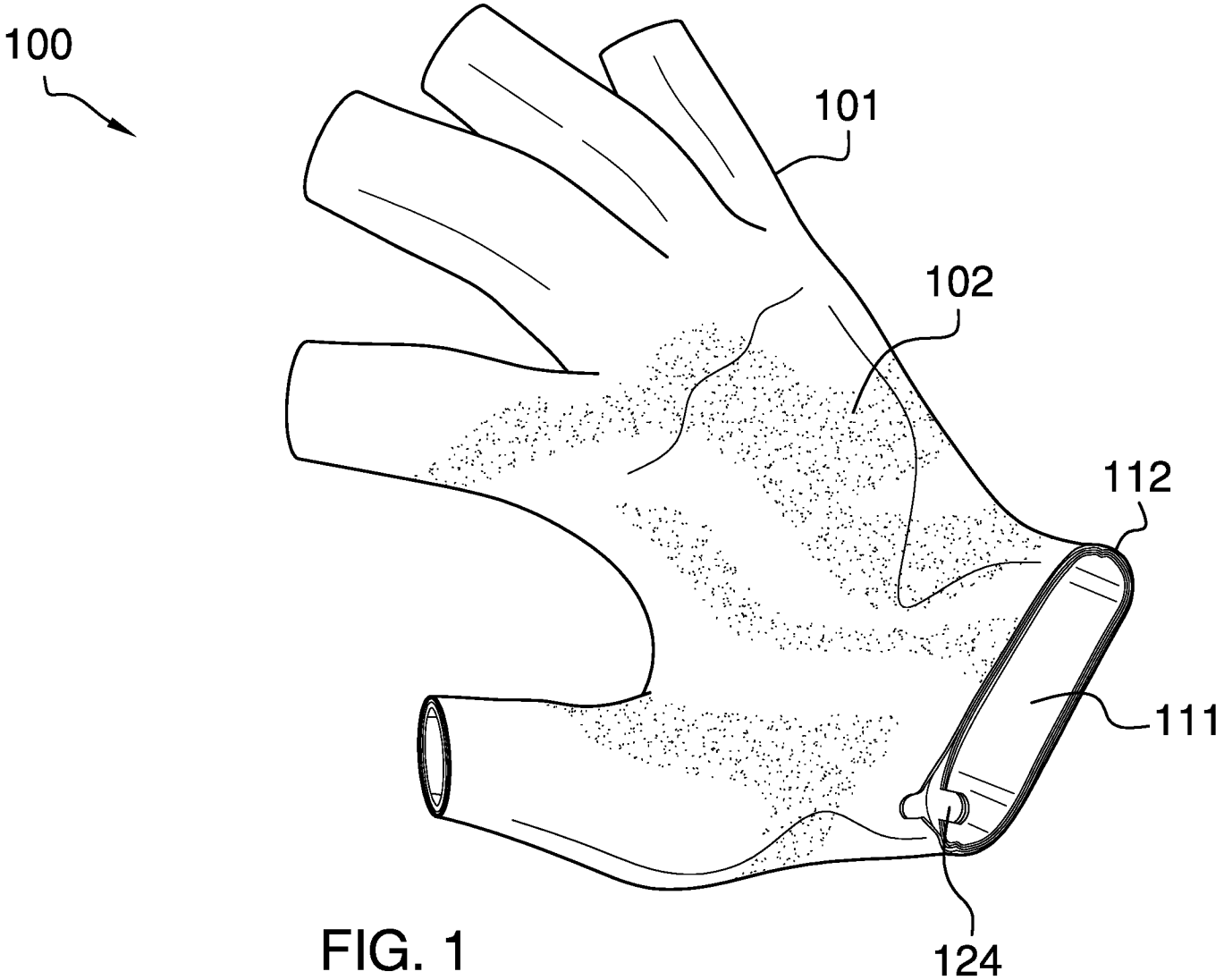
FIG. 1 is a perspective view of an embodiment of the disclosure.
Figure 2:
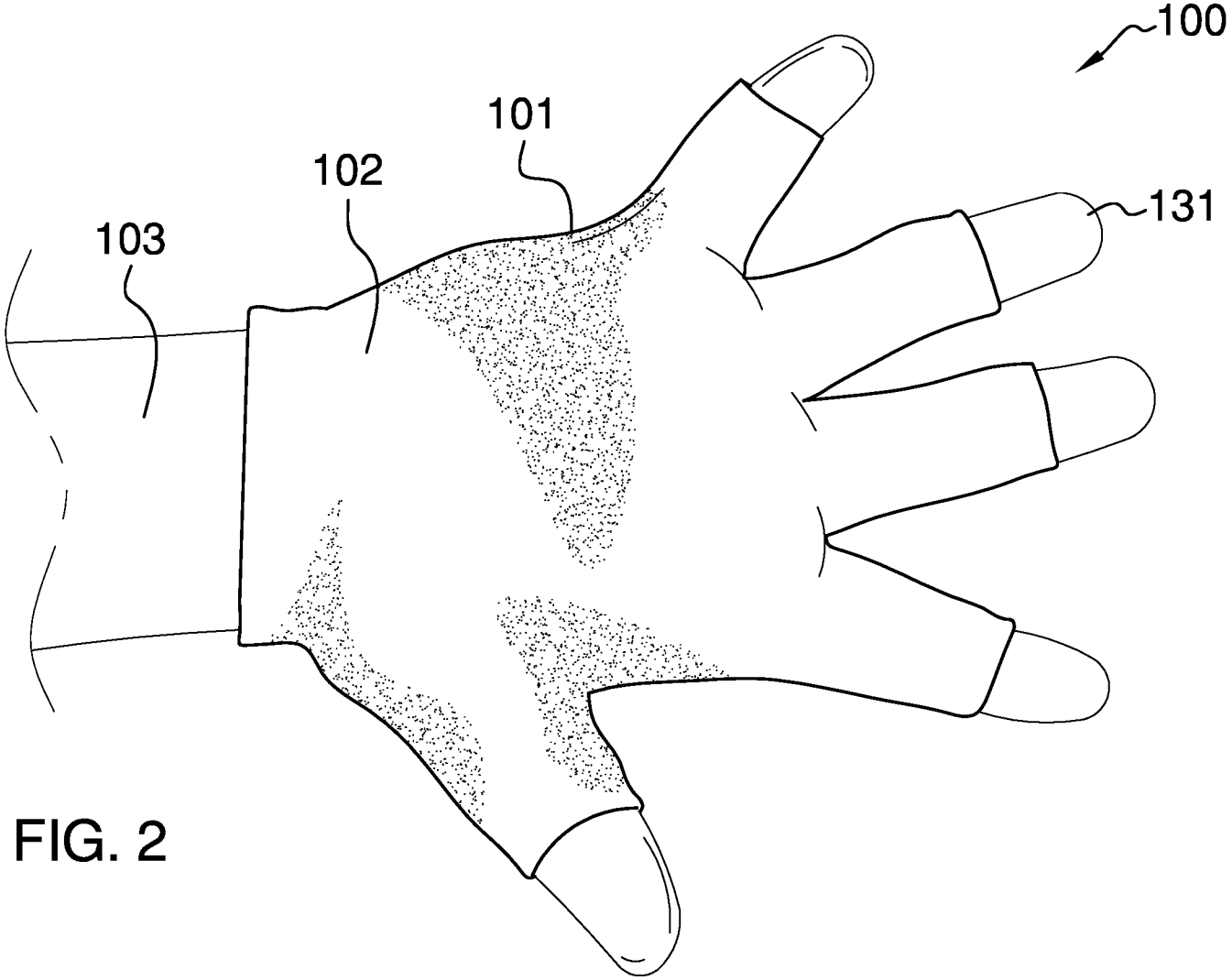
FIG. 2 is a bottom view of an embodiment of the disclosure.
Figure 3:
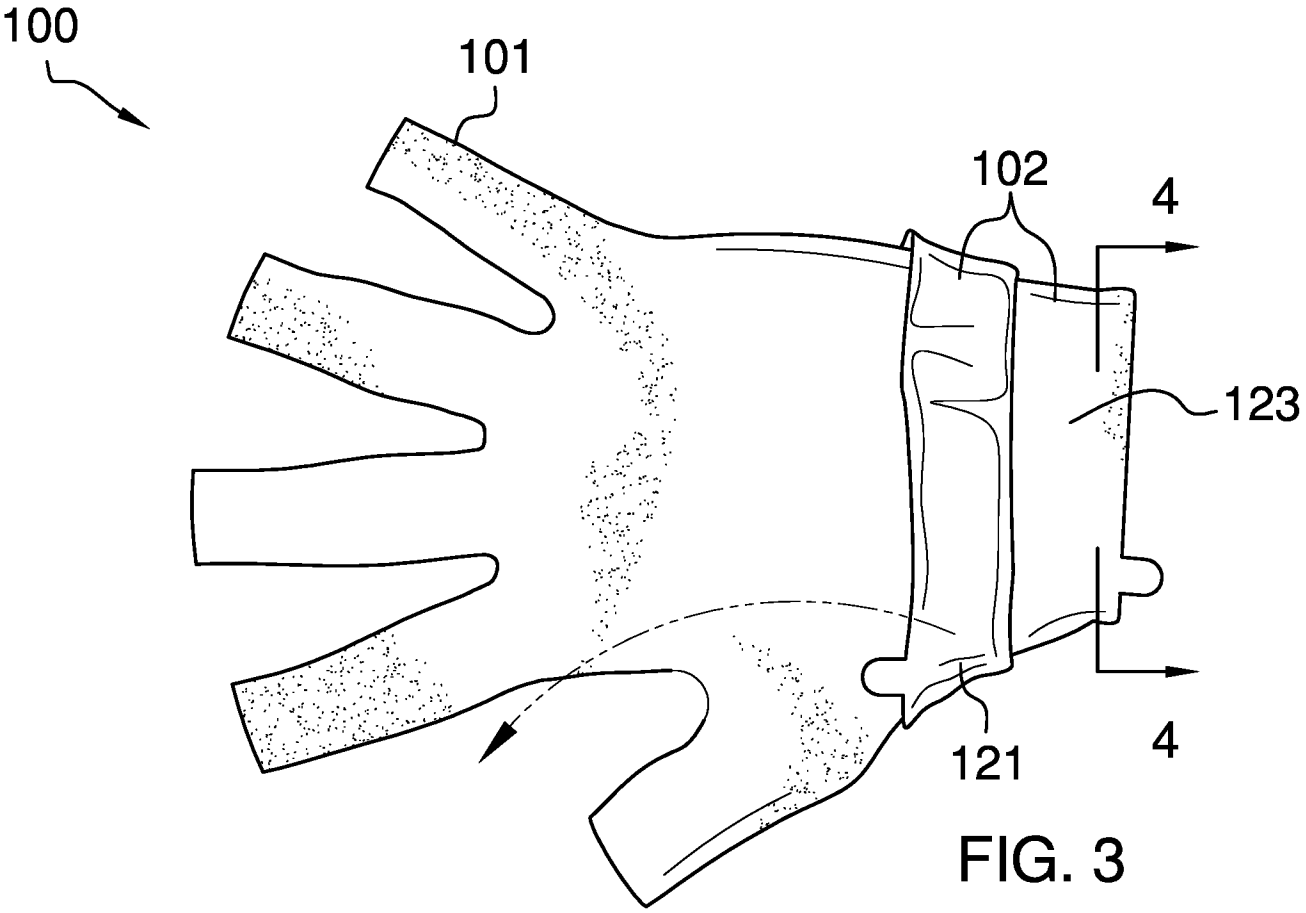
FIG. 3 is a top view of an embodiment of the disclosure.
Figure 4:
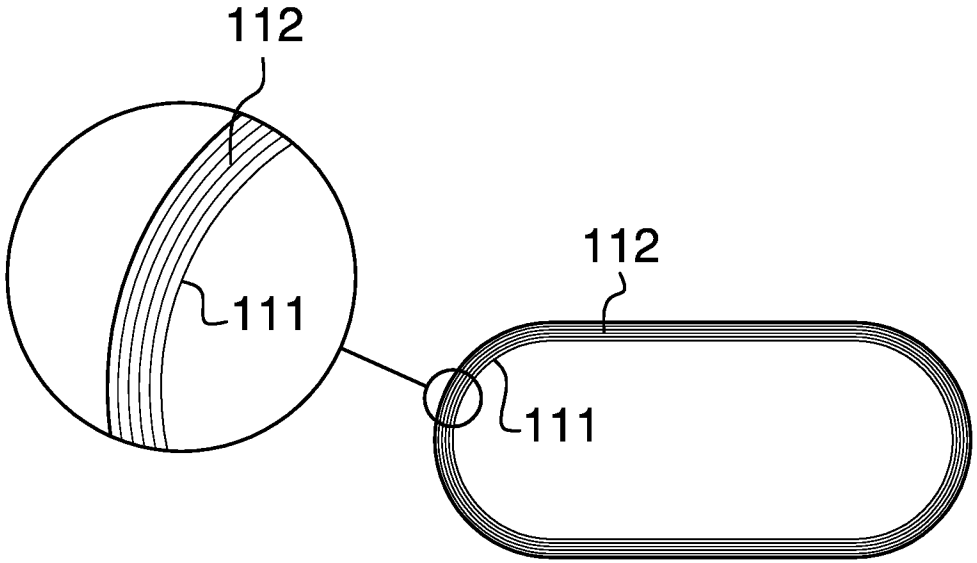
FIG. 4 is a detail view of an embodiment of the disclosure.
Figure 5:
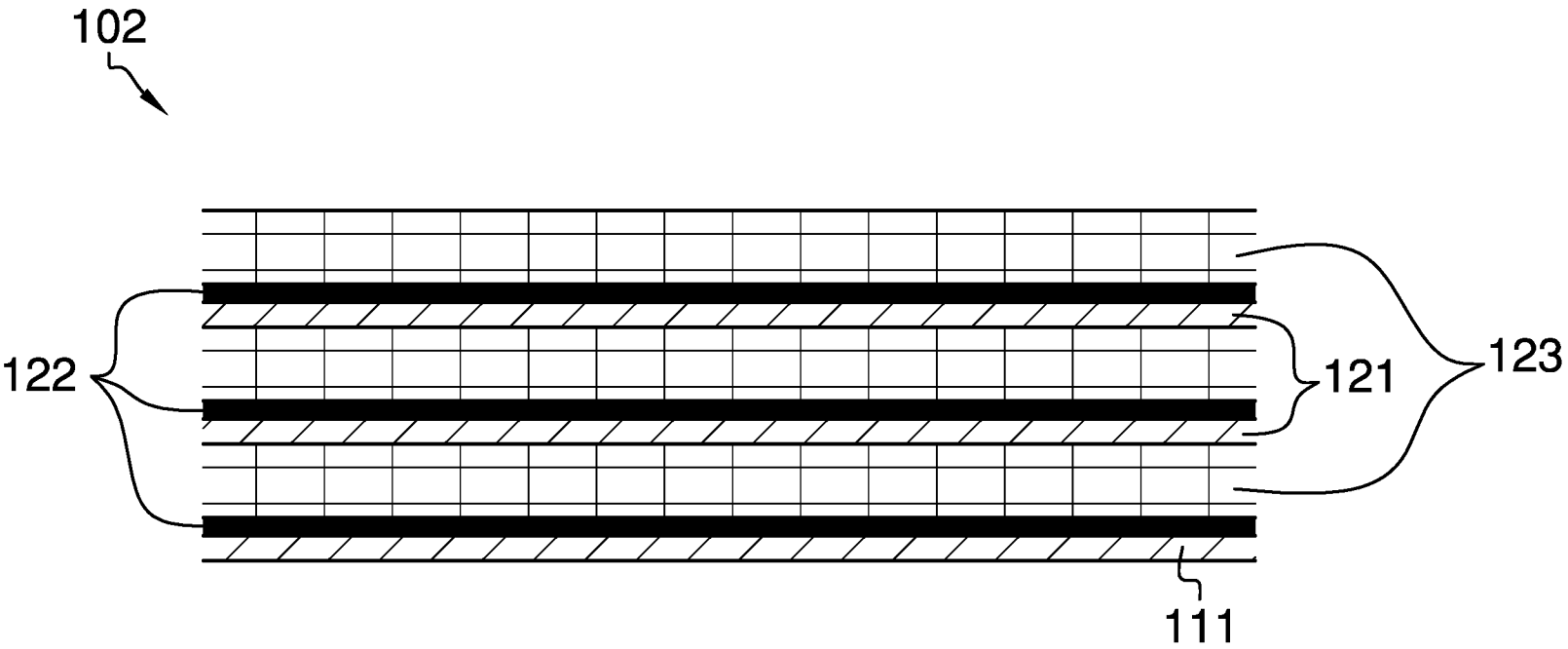
FIG. 5 is a detail view of an embodiment of the disclosure.

Detailed reference will now be made to one or more potential embodiments of the disclosure, which are illustrated in FIGS. 1 through 5.

The nose and face wiping glove 100 (hereinafter invention) is a garment. The invention 100 is adapted for use with a patient 103. The invention 100 is worn on the hand 131 of a patient 103. The invention 100 is an absorbent structure. The absorbent structure of the invention 100 is intended to accumulate a fluid discharge from the nose of the patient 103. The invention 100 is a layered structure. The layered structure provides the patient with 103 sequential access to a plurality of independent absorbent structures. The invention 100 is formed as a glove 101. The glove 101 of the invention 100 is formed from a composite textile 102. The patient 103 is an individual designated to wear the glove 101. The patient 103 is defined elsewhere in this disclosure.

The glove 101 is a garment. The glove 101 is adapted to be worn by a patient 103. The glove 101 is worn on a hand 131 of the patient 103. The exterior surface of the glove 101 is formed with an absorbent structure used to accumulate any fluid discharged from the nose of the patient 103. The glove 101 is formed from the composite textile 102 structure. In the first potential embodiment of the disclosure, the end of each finger stall that is distal from the trank of the glove 101 is removed such that the fingers of the hand 131 extend beyond the glove 101.

The composite textile 102 is a single sheeting used to form the glove 101. The composite textile 102 forms the absorbent structure of the glove 101. The composite textile 102 is a layered structure. The outer layer of the composite textile 102 forms the absorbent structure of the glove 101. The composite textile 102 is a layered structure such that the outer layer of the composite textile 102 can be removed to expose a fresh absorbent structure that becomes available for use after the prior absorbent structure becomes saturated. The composite textile 102 is an elastomeric structure.

The composite textile 102 acts as a spring. Specifically, when the hand 131 of the patient 103 inserts into the glove 101, a radial force is applied to the composite textile 102 that forms the glove 101 in a direction away from the center of the glove 101. The applied radial force elongates the span of the diameter of the glove 101 in the direction away from the center of the glove 101. The elasticity of the composite textile 102 that forms the glove 101 creates a force that opposes the displacement created by the applied force. The elasticity of the composite textile 102 that forms the glove 101 returns the glove 101 to its relaxed shape. The hand 131 of the patient 103 will prevent the composite textile 102 that forms the glove 101 from returning to its relaxed shape. In this circumstance, the composite textile 102 that forms the glove 101 will apply a force projecting radially towards the center of the glove 101 that binds glove 101 to the hand 131 of the patient 103.

Methods to form a glove 101 from the composite textile 102 described above are well-known and documented in the medical arts.

The composite textile 102 comprises a base layer 111 and a plurality of flocked layers 112. The plurality of flocked layers 112 attach to the base layer 111. The base layer 111 is an elastic polyurethane sheeting. The base layer 111 forms the interior surface of the glove 101 that presses against the hand 131 when the glove 101 is worn by the patient 103.

Each of the plurality of flocked layers 112 is a composite structure. Each of the plurality of flocked layers 112 is an absorbent structure. Each of the plurality of flocked layers 112 are layered on top of each other to form the composite textile 102. The layering of each of the plurality of flocked layers 112 allows the outer flocked layer of the plurality of flocked layers 112 to be removed once the absorbent structure formed by the outer flocked layer is saturated. The removed outer flocked layer is disposable. The removed outer flocked layer is replaced by the flocked layer of the plurality of flocked layers 112 that is directly underneath the removed outer flocked layer. The plurality of flocked layers 112 comprises a plurality of polyurethane layers 121, a plurality of adhesive layers 122, and a plurality of absorbent layers 123.

Each flocked layer selected from the plurality of flocked layers 112 comprises an elastic polyurethane sheeting selected from the plurality of polyurethane layers 121 and an absorbent layer selected from the plurality of absorbent layers 123. An adhesive layer selected from the plurality of adhesive layers attaches the selected absorbent layer to the selected elastic polyurethane sheeting of the selected flocked layer. The selected adhesive layer is formed from a removable adhesive. The selected absorbent layer is formed from a plurality of fibers and filaments. The selected adhesive layer attaches the selected absorbent layer to the selected elastic polyurethane sheeting using a flocking process. The selected adhesive layer is applied such that the selected adhesive layer attaches the selected flocked layer to the elastic polyurethane sheeting associated with the flocked layer selected from the plurality of flocked layers 112 of that is adjacent to the initially selected flocked layer.

The base layer 111 is the elastic polyurethane sheeting that is initially selected to form the layered structure of the composite textile 102. The base layer 111 is the elastic polyurethane sheeting associated with the flocked layer selected from the plurality of flocked layers 112 that is proximal to the hand 131 of the patient 103.

Each of the plurality of adhesive layers 122 is a removable adhesive. Each of the plurality of adhesive layers 122 attaches the selected absorbent layer to the selected elastic polyurethane sheeting of the selected flocked layer.

Each of the plurality of absorbent layers 123 is an absorbent structure. Each of the plurality of absorbent layers 123 of the flocked layer selected from the plurality of flocked layers 112 absorbs any fluid discharge from the nose of the patient 103.

The plurality of polyurethane layers 121 further comprises a plurality of tabs 124. Each of the plurality of tabs 124 is a tab that attaches an elastic polyurethane sheeting selected from the plurality of polyurethane layers 121. There is a one to one correspondence between the plurality of tabs 124 and the plurality of polyurethane layers 121 such that each elastic polyurethane layer selected from the plurality of polyurethane layers 121 has associated with it a tab selected from the plurality of tabs 124. Each selected tab provides a grip that allows the patient 103 to remove the exterior flocked layer selected from the plurality of flocked layers 112 such that the flocked layer underneath the exterior flocked layer is exposed to become the new exterior flocked layer.

The following definitions were used in this disclosure:

Absorbent: As used in this disclosure, absorbent is an adjective that refers to a material that is able to soak up a liquid such as water.

Adhesive: As used in this disclosure, an adhesive is a chemical substance that can be used to adhere two or more objects to each other. Types of adhesives include, but are not limited to, epoxies, polyurethanes, polyimides, or cyanoacrylates, silicone, or latex based adhesives.

Appendage: As used in this disclosure, appendage is a generic term used to describe one or more limbs of a patient.

Carbamate: As used in this disclosure, a carbamate is a functional group consisting of an O—(C═O)—N structure. Carbamate is informally referred to as urethane.

Center: As used in this disclosure, a center is a point that is: 1) the point within a circle that is equidistant from all the points of the circumference; 2) the point within a regular polygon that is equidistant from all the vertices of the regular polygon; 3) the point on a line that is equidistant from the ends of the line; 4) the point, pivot, or axis around which something revolves; or, 5) the centroid or first moment of an area or structure. In cases where the appropriate definition or definitions are not obvious, the fifth option should be used in interpreting the specification.

Composite Textile: As used in this disclosure, a composite textile is a multilayer fabric made of two or more joined layers of textile or sheeting materials.

Copolymer: As used in this disclosure, a copolymer is a polymer formed from two or more repeating molecules (also referred to as monomers).

Diameter: As used in this disclosure, a diameter of an object is a straight line segment (or a radial line) that passes through the center (or center axis) of an object. The line segment of the diameter is terminated at the perimeter or boundary of the object through which the line segment of the diameter runs. A radius refers to the line segment that overlays a diameter with one termination at the center of the object. A span of a radius is always one half the span of the diameter.

Disposable: As used in this disclosure, disposable is an adjective that refers to an object that is designed and intended for a single use. Within this context, an object would be considered disposable if it is not reusable after its initial use.

Elastic: As used in this disclosure, an elastic is a material or object that deforms when a force is applied to it and that is able to return to its relaxed shape after the force is removed. A material that exhibits these qualities is also referred to as an elastomeric material. A material that does not exhibit these qualities is referred to as inelastic or an inelastic material.

Extremity: As used in this disclosure, extremity is a generic term used to describe either the hand and/or foot of a person. The extremity is located and the distal end of an appendage.

Fiber: As used in this disclosure, a fiber is a slender elongated structure.

Filament: As used in this disclosure, a filament is a thread like fiber or object that is used in the production of a yarn.

Finger Stall: As used in this disclosure, a finger stall refers to: 1) the roughly cylindrical structure associated with a glove into which a finger may be inserted; or, 2) a roughly cylindrical cover, commonly referred to as a finger cot, that is placed directly over a finger to cover the finger.

Flocking: As used in this disclosure, flocking refers to a textured surface on a substrate. Specifically, flocking refers to the adhering of a plurality of fibers to the surface of the substrate.

Garment: As used in this disclosure, a garment is a textile-based structure that is used to cover an individual.

Clothes, clothing, and apparel are synonyms for garment.

Glove: As used in this disclosure, a glove is an item of apparel that covers a hand. The glove comprises five finger stalls into which the fingers of the hand are inserted. The glove further comprises the trank which encloses the hand from the fingers to the wrist. A glove is further defined with a palm side and a back side. The palm side is proximal to the palm of the hand. The back side is distal from the palm side.

Hand: As used in this disclosure, the hand is the extremity of the arm. The hand attaches to the wrist at the end that is distal from the shoulder. The hand comprises a plurality of metacarpal bones and a plurality of phalange bones.

Monomer: As used in this disclosure, a monomer refers to a molecular structure that bonds to itself in a repeating manner to form a polymer.

Patient: As used in this disclosure, a patient is a person who is designated to receive a medical treatment, therapy or service. The term patient may be extended to an animal when used within the context of the animal receiving veterinary treatment or services.

Polymer: As used in this disclosure, a polymer refers to a molecular chain that comprises multiple repeating units known as monomers. The repeating unit may be an atom or a molecular structure.

Polyurethane: As used in this disclosure, a polyurethane is a copolymer wherein the one or more monomer chains are linked together carbamates.

Relaxed Shape: As used in this disclosure, a structure is considered to be in its relaxed state when no shear, strain, or torsional forces are being applied to the structure.

Removable Adhesive: As used in this disclosure, a removable adhesive is a commercially available adhesive that is designed with a lower tack, or stickiness, such that a first object is attached to a second object with a removable adhesive the first object can be readily removed in a manner that ideally, though not necessarily practically, leaves behind no adhesive residue on the second object. A repositionable adhesive is a subset of removable adhesives that are intended to allow the first object to be reattached to a third object or the second object in the initial or a different position. Within this disclosure, a removable adhesive is assumed to include repositionable adhesives.

Radial: As used in this disclosure, the term radial refers to a direction that: 1) is perpendicular to an identified central axis; or, 2) projects away from a center point.

Sheeting: As used in this disclosure, a sheeting is a material, such as a paper, textile, a plastic, or a metal foil, in the form of a thin flexible layer or layers.

Spring: As used in this disclosure, a spring is a device that is used to store mechanical energy. This mechanical energy will often be stored by: 1) deforming an elastomeric material that is used to make the device; 2) the application of a torque to a semi-rigid structure; or 3) a combination of the previous two items.

Tab: As used in this disclosure, a tab is a first object that is attached to a second object for the purpose of: facilitating the manipulation of the second object; or, 2) identification of the second object.

Textile: As used in this disclosure, a textile is a material that is woven, knitted, braided or felted. Synonyms in common usage for this definition include fabric and cloth.

Trank: As used in this disclosure, the trank refers to the portion of a glove that covers the hand from the fingers to the wrist.

With respect to the above description, it is to be realized that the optimum dimensional relationship for the various components of the invention described above and in FIGS. 1 through 5 include variations in size, materials, shape, form, function, and manner of operation, assembly and use, are deemed readily apparent and obvious to one skilled in the art, and all equivalent relationships to those illustrated in the drawings and described in the specification are intended to be encompassed by the invention.

It shall be noted that those skilled in the art will readily recognize numerous adaptations and modifications which can be made to the various embodiments of the present invention which will result in an improved invention, yet all of which will fall within the spirit and scope of the present invention as defined in the following claims. Accordingly, the invention is to be limited only by the scope of the following claims and their equivalents.

The inventors claim:

1. A sanitary glove comprising wherein the sanitary glove is formed as a glove;

wherein the glove of the sanitary glove is formed from a composite textile;

wherein the sanitary glove is a garment;

wherein the sanitary glove is adapted for use with a patient;

wherein the sanitary glove is worn on the hand of a patient;

wherein the sanitary glove is an absorbent structure;

wherein the absorbent structure of the sanitary glove is intended to accumulate a fluid discharge from the patient;

wherein the composite textile comprises a base layer and a plurality of flocked layers;

wherein the plurality of flocked layers attach to the base layer;

wherein the plurality of flocked layers comprises a plurality of polyurethane layers, a plurality of adhesive layers, and a plurality of absorbent layers;

wherein each flocked layer selected from the plurality of flocked layers comprises an elastic polyurethane sheeting selected from the plurality of polyurethane layers and an absorbent layer selected from the plurality of absorbent layers;

wherein an adhesive layer selected from the plurality of adhesive layers attaches the selected absorbent layer to the selected elastic polyurethane sheeting of the selected flocked layer.

2. The sanitary glove according to claim 1 wherein the sanitary glove is a layered structure;

wherein the layered structure provides the patient with sequential access to a plurality of independent absorbent structures.

3. The sanitary glove according to claim 2 wherein the glove is a garment;

wherein an exterior surface of the glove is formed with an absorbent structure.

4. The sanitary glove according to claim 3 wherein the composite textile is a single sheeting;

wherein the composite textile forms the absorbent structure of the glove.

5. The sanitary glove according to claim 4 wherein the composite textile is a layered structure;

wherein the outer layer of the composite textile forms the absorbent structure of the glove.

6. The sanitary glove according to claim 5 wherein the composite textile is a layered structure such that the outer layer of the composite textile can be removed to expose a fresh absorbent structure that becomes available for use after the prior absorbent structure becomes saturated.

7. The sanitary glove according to claim 6 wherein the composite textile is an elastomeric structure.

8. The sanitary glove according to claim 7 wherein the base layer is an elastic polyurethane sheeting;

wherein the base layer forms the interior surface of the glove that presses against the hand when the glove is worn by the patient.

9. The sanitary glove according to claim 8 wherein each of the plurality of flocked layers is a composite structure;

wherein each of the plurality of flocked layers is the absorbent structure;

wherein each of the plurality of flocked layers are layered on top of each other to form the composite textile.

10. The sanitary glove according to claim 9 wherein the layering of each of the plurality of flocked layers allows the outer flocked layer of the plurality of flocked layers to be removed once the absorbent structure formed by the outer flocked layer is saturated;

wherein the removed outer flocked layer is disposable;

wherein the removed outer flocked layer is replaced by the flocked layer of the plurality of flocked layers that is directly underneath the removed outer flocked layer.

11. The sanitary glove according to claim 10 wherein the selected adhesive layer is formed from a removable adhesive;

wherein the selected absorbent layer is formed from a plurality of fibers and filaments.

12. The sanitary glove according to claim 11 wherein the selected adhesive layer is applied such that the selected adhesive layer attaches the selected flocked layer to the elastic polyurethane sheeting associated with the flocked layer selected from the plurality of flocked layers of that is adjacent to the initially selected flocked layer.

13. The sanitary glove according to claim 12 wherein the base layer is the elastic polyurethane sheeting associated with the flocked layer selected from the plurality of flocked layers that is proximal to the hand of the patient.

14. The sanitary glove according to claim 13 wherein each of the plurality of adhesive layers is a removable adhesive;

wherein each of the plurality of adhesive layers attaches the selected absorbent layer to the selected elastic polyurethane sheeting of the selected flocked layer.

15. The sanitary glove according to claim 14 wherein each of the plurality of absorbent layers is an absorbent structure;

wherein each of the plurality of absorbent layers of the flocked layer selected from the plurality of flocked layers absorbs any fluid discharge from the nose of the patient.

16. The sanitary glove according to claim 15 wherein the plurality of polyurethane layers further comprises a plurality of tabs;

wherein each of the plurality of tabs is a tab that attaches an elastic polyurethane sheeting selected from the plurality of polyurethane layers.

17. The sanitary glove according to claim 16 wherein there is a one to one correspondence between the plurality of tabs and the plurality of polyurethane layers such that each elastic polyurethane layer selected from the plurality of polyurethane layers has associated with it a tab selected from the plurality of tabs;

wherein each selected tab provides a grip that allows the patient to remove the exterior flocked layer selected from the plurality of flocked layers such that the flocked layer underneath the exterior flocked layer is exposed to become the new exterior flocked layer.

18. The sanitary glove according to claim 17 wherein the selected adhesive layer attaches the selected absorbent layer to the selected elastic polyurethane sheeting using a flocking process.

* * * * *